United States Patent [19]

Potratz

[11] 4,262,762

[45] Apr. 21, 1981

[54] ANTI-COLLARING STRUCTURE FOR IMPACT BIT

[76] Inventor: Robert P. Potratz, 10615 E. 11th Ave., Spokane, Wash. 99206

[21] Appl. No.: 82,693

[22] Filed: Oct. 9, 1979

[51] Int. Cl.[3] ..... E21B 10/44

[52] U.S. Cl. ..... 175/401; 175/395

[58] Field of Search ..... 175/323, 395, 401, 408

[56] References Cited

U.S. PATENT DOCUMENTS

| | | | |
|---|---|---|---|
| 2,558,341 | 6/1951 | Cory et al. | 175/401 |
| 2,579,720 | 12/1951 | Atkinson | 175/408 X |
| 2,602,639 | 7/1952 | Green | 175/401 |
| 3,043,385 | 7/1962 | Boyle | 175/401 |
| 3,128,835 | 4/1964 | Kirker | 175/401 |
| 3,608,654 | 9/1971 | Powell et al. | 175/395 X |

FOREIGN PATENT DOCUMENTS

| | | | |
|---|---|---|---|
| 951136 | 10/1949 | France | 175/395 |

*Primary Examiner*—James A. Leppink
*Assistant Examiner*—Richard E. Favreau
*Attorney, Agent, or Firm*—Keith S. Bergman

[57] ABSTRACT

Rib structure for an impact type rock drilling bit, spirally oriented on the external surface of the bit to move particulate matter forwardly relative to the bit when it be turned in its normal drilling direction, to aid the process of extraction of the bit from a drilled hole.

3 Claims, 5 Drawing Figures

ANTI-COLLARING STRUCTURE FOR IMPACT BIT

BACKGROUND OF INVENTION

A. Related Applications

There are no applications related hereto filed in this or any foreign country prior to the filing hereof.

B. Field of Invention

This invention relates generally to bits for impact type drills and more particularly to a helical rib structure thereon to aid in preventing collaring during bit withdrawal.

C. Description of Prior Art

In the percussion drilling of rock an ever present problem is that of removing the drill from a hole without collaring or binding in the hole already drilled. In the case of pneumatic type drilling this problem recently has been accentuated by safety regulations requiring that particulate matter be dampened or wetted to aid in preventing its becoming a health hazard. When the dust and particles are wetted they tend to agglomerate in a drilled hole behind the drill bit and when the bit be removed through that hole the probability of collaring is substantially increased, with resultant inefficiency and often substantial losses of both labor and materials. The instant invention seeks to lessen or alleviate this problem.

The normal impact type rock drill has a bit of larger diameter carried at the end of a shaft or drill stem of smaller diameter. The drill bit to be functional must have a rearward (toward the drill stem) taper generally of about three degrees so that the forwardmost drilling portion is of a slightly greater diameter than the rearward body portion of the bit. When a bit of this somewhat truncated conic configuration is extracted from a drilled hole there is a tendency for any particulate debris in the hole to become wedged between the bit and the walls defining the hole, oftentimes to make extraction of the bit difficult or even impossible. This happening in the vernacular of the drilling arts is commonly called "collaring." In the dry drilling of holes with the use of appropriate pneumatic pressure to blow particulate debris back out of the hole, collaring though an ever present problem is not too severe a problem. When the particulate drilling debris is wetted enough to comply with modern day health safety standards, however, it tends to agglomerate on the sides of the drill hole rearwardly of the bit and to remain there prior to the extraction of the bit no matter how much air pressure may be applied through the hole. Since the advent of these safety standards requiring the wetting of drilling debris, substantially more time has been required to remove the bits from drilled holes than was the case before those safety standards, with the same equipment. In fact the amount of footage that a driller can drill in a given period of time has been reduced in some cases by thirty to fifty percent depending upon the parameters of the particular situation.

Especially since the advent of extremely hard carbide type drilling bits it has become feasible to drill holes up to several hundred feet in length with impact drills and because of this compound type drill stems have come into common use. Generally these drill stems are threadedly attached to each other and to the drill bit. This threaded attachment of drill stem to drill stem or drill stem to bit has become quite specialized so as to provide a quick connecting or disconnecting joint and one which concentrates impact forces on shoulders or surfaces perpendicular to the direction of impact so that the impact is not carried directly by the threads. This construction has provided a compound drill with parts quite readily disconnectible that may be rotated in only one direction, all to compound the problem of removing the drill from holes and of collaring during the process. Before the advent of compound drill stems commonly unitary drill stems could be rotated successively in opposite directions to aid removal and prevent collaring during the withdrawal operation, but the compound, threadedly connected type of drill stem has made this impossible. Again, commonly with impact rock bits heretofore known, one or more helical ribs have been provided on the rearward diametrically smaller part of the bit angled in such fashion as to aid in moving particulate matter being drilled rearwardly out of the hole when the bit be rotated in the direction to tighten its threaded connections. When such a bit is being withdrawn from a hole these helical ribs will tend to move debris on the drill hole walls rearwardly out of the drilled hole ahead of the bit as it is extracted therefrom, again to make the removal more difficult and increase the probability of collaring the bit in the hole.

My invention seeks to alleviate these problems by providing a typical modern day impact rock drill bit with helical ribs on the diametrically smaller rearward portion so angled as to have a screw effect causing particulate matter in the hole rearwardly of the drill to be moved past the drill and into the forwardmost drilled portion of the hole when the drill be rotated in a direction to tighten the threaded connections of the drill stem during the removal process. My bit then instead of moving debris in the hole in front of the bit as it is extracted tends to move the material through the flutes in the drill past the drill bit so that the debris remains in the hole to make bit removal easier, allow rotation of the bit upon removal and tend to lessen the probability of collaring the bit during the removal process. My invention lies in the unique combination of particularly configured structures that allow this function and not in any one of these structures per se.

Heretofore the basic concept of using helical ribs to move particulate matter in a drilled hole forwardly into the hole and past a bit during the extraction process was disclosed by Atkinson in U.S. Pat. No. 2,579,720. The Atkinson device, however, differs in function from the instant invention in that it, to be operative if at all, would require a unitary drill stem since that stem would have to be rotated opposite its normal drilling rotation during the extraction process to cause particulate matter in the hole to pass forwardly into the already drilled hole and past the bit being extracted. This counter-rotation is impossible with present day compound drill stems as the drill stem would come apart and a forward part of the drill would be lost in the hole. To date, at least, no satisfactory locking device has been found to lock the threadedly connected drill stem or bit together against counter-rotation. The Atkinson device also differs in structure from the instant invention in that Atkinson's helical ribs are not continuous from the cutting portion of the drill rearwardly, but rather leave a space between the cutting portion of the drill and the forward part of the ribs which tends to allow collaring within that space and even to increase the probability of collaring above that existing if the ribs were not present. The helical ribs of the instant invention are continuous from their rearwardmost portion forwardly to the drilling portion of the bit and are substantially of the same radius as the gauge clearance of the bit to lessen the probability of collaring. The cross-sectional shape of the ribs of the instant invention is rectangular rather than curvilinear as in the Atkinson device so as to tend to move particles parallel to the drill hole rather than allowing their passage over the drill ribs. The instant invention thus differs both in structure and function from the Atkinson device.

SUMMARY OF INVENTION

My invention generally provides one or more helical ribs on the body of a drill bit to direct particulate material past the bit into a vacated hole as the bit is rotatively retracted therefrom.

My invention is particularly adapted for use with a compound impact type rock drill having a drill bit threadedly connected with one or more drill rods to form a drill stem. The invention includes one or more ribs of helical shape carried by the periphery of the diametrically smaller drill body rearwardly of and continuously in communication with the diametrically larger drilling element. The helical ribs are so angled that when the drill be turned in its normal drilling direction the material engaged by the ribs will be moved toward the tip of the drill through flutes defined in the drilling element. The ribs extend radially outwardly from the drill bit substantially to the diameter of the drill gauge clearance. The rib structure is adapted to be added to an ordinary impact drill of present day commerce and allow use of such drill in normal and customary fashion heretofore existing.

In providing such a structure it is:

A principal object of my invention to provide an impact type rock drill having at least one helical rib on the drill body to aid in removal of the drill from a drill hole and lessen the probability of its collaring during removal.

A further object of my invention to provide rib structure as aforesaid that is so positioned that when the drill be rotated in its normal drilling direction the helical rib or ribs will tend to move particulate material in the drilled hole forwardly (toward the drill tip) into flutes defined in the drill bit.

A further object of my invention to provide such a structure that extends rearwardly continuously from the drilling element of a normal drill without any intervening space therebetween.

A still further object of my invention to provide such a structure that allows a drill to be rotated in its normal drilling direction during extraction both to aid the extraction, prevent collaring and maintain the inter-connection of drill parts.

A still further object of my invention to provide such a structure that can be added to an ordinary drill bit of present day commerce to allow the operation of the drill in the same fashion as would be had without the invention.

A still further object of my invention to provide such a structure that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention, however, it is to be understood that its features are susceptible of change in design and structural arrangement with only one preferred and practical embodiment being illustrated in the accompanying drawings, as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

My invention comprises generally impact drill bit 10 of present day commercial design having a diametrically larger forward drilling portion 12 and a diametrically smaller rearward shank portion 13 with at least one helical rib 11 carried by the shank portion and angled to move particulate matter toward the drilling portion when the drill be rotated in normal fashion. The term "forward" as used herein refers to the direction in which drilling is accomplished, that is that direction most distal in the drill hole from the mouth, the term "rearward" refers to the opposite direction. In describing my invention "normal" direction of rotation is taken to be counter-clockwise when one looks forwardly along a drill stem, as that is the direction of rotation of most drills of present day commerce.

Figure 1:
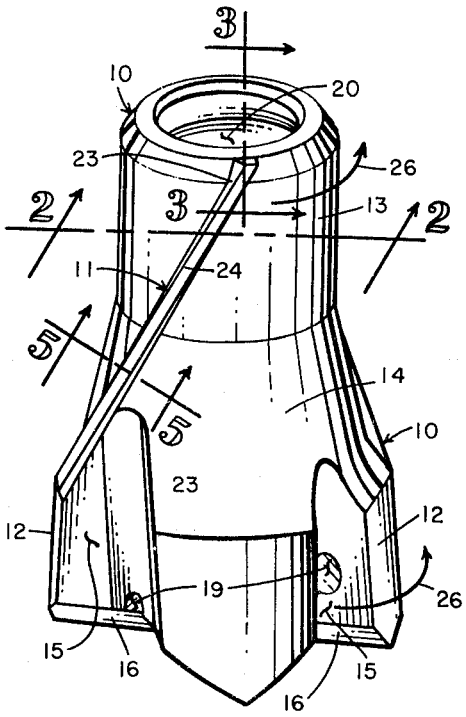
FIG. 1 is an isometric, surface view of an impact drill bit of commerce embodying my invention, showing its parts, their configuration and relationship.
Figure 2:
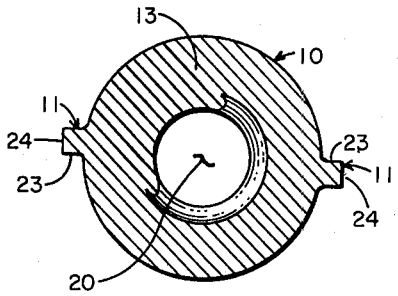
FIG. 2 is a horizontal, cross-sectional view of the drill bit of FIG. 1 taken on the line 2—2 thereon in the direction indicated by the arrows.
Figure 4:
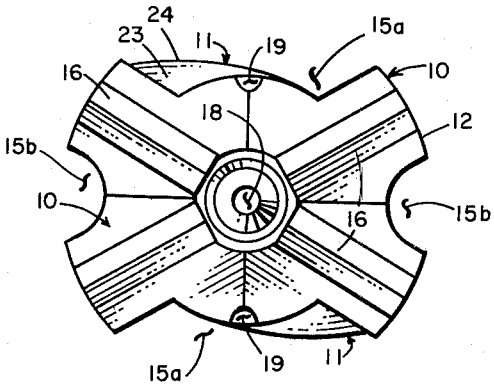
FIG. 4 is an orthographic bottom view, looking upwardly at the drill illustrated in FIG. 1, to show particularly the cutter structure.
Figure 3:
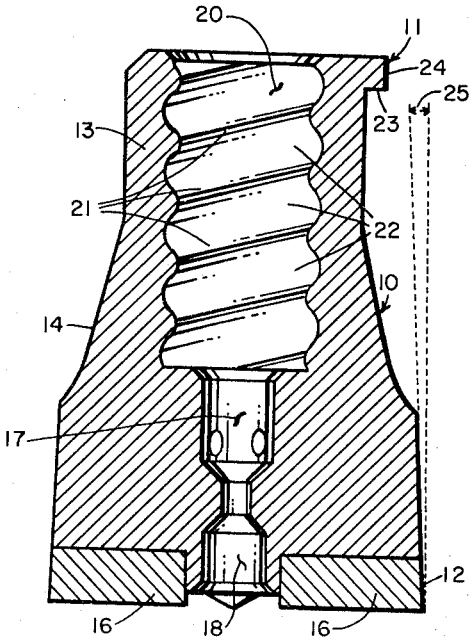
FIG. 3 is a vertical, cross-sectional view of the drill bit of FIG. 1 taken on the line 3—3 thereon in the direction indicated by the arrows.

A typical impact drill bit 10 as used in the present day drilling art is illustrated in the drawings and particularly that of FIG. 1. It provides forward diametrically larger drilling portion 12 structurally communicating with diametrically smaller rearward shank portion 13 by sloping transition shoulder 14. Drilling portion 12 tapers inwardly toward the rear, usually about three degrees, to establish the gauge clearance, that is planar angle 25 between the surface of the drilling portion and the drilled hole wall and is provided with plural flutes 15 to allow passage of particulate material rearwardly of the bit. A plurality of hard carbide tips 16, commonly the same in number as the number of flutes 15, are provided on the forwardmost face of the drill bit to make drilling contact with the rock surface forwardly of the bit. In most modern day rock drills four carbide inserts or buttons are used. They are symmetrically positioned about the axis of the drill bit commonly in the "X" array illustrated in FIG. 4 with two diametrically opposed flutes 15*a* larger than the other two flutes 15*b*.

Drilling media passageway 17 communicates from the drill rod chamber defined in the forward surface of the drill. Commonly there will be one medial orifice 18 and a plurality of flute orifices 19 in the forward medial portion of each flute 15.

Rearward shank portion 13 is a cylindrical element, somewhat diametrically smaller than drilling portion 12, defining medial drill rod chamber 20 to receive and releasably attach a drill rod (not shown) to the bit. Commonly the attachment of the drill rod will be by threaded engagement with the bit. Because of the nature of the drilling operation it is desirable that this connection be rapidly establishable and that impact be transferred from the drill rod to the bit by means of a relatively large surface perpendicular to the impact force such as a shoulder rather than the threaded communication between elements per se. Several types of variously configured connections have become known to accomplish this purpose. The one illustrated is commonly known as a "rope thread" with similar half-circle shaped crests 21 and roots 22. Air passageway 17 communicates to drill rod chamber 20 so that pressurized air supplied through the hollow drill rod and to the chamber may pass into various passageways 18, 19 to aid the drilling function by moving particulate material through flutes 15 and rearwardly of the drill bit.

The drill bit is releasably supported on a drill rod (not shown) threadedly engaged in drill rod chamber 20. Commonly this drill rod will be of a compound nature formed of a plurality of individual pieces, each threadedly inter-connected with the other. By reason of this threaded inter-connection of the drill bit and drill rod, if the drill be rotated, it must be rotated in one direction or its various parts will become disconnected. Commonly because of the nature of the threaded engagement of the several parts they are quite easily threadedly disengaged from each other and oftentimes appropriately directed torque must be maintained upon them to sustain their threaded engagement.

The essential features specified for an impact type rock drilling bit, as commonly used in the mining and engineering fields to drill relatively short holes of relatively small diameter especially as for exploring or blasting are subtantially the same in all bits though particular accidental features may vary widely. Commonly in the past the drilling with such bits has been "dry" that is, no water or other fluid, has been artificially introduced into the drilling operation and debris has been removed from around the bit and through the drill hole by means of pressurized air introduced into the drill hole through the bit. Such drilling activity, however, produces many small particles of rock debris in the drilling operation and dispenses them into the environs thereabout. It has been determined in the recent past that this particulate matter may be a health hazard to drillers and others in the immediate environs of the drilling operation. Responsively various regulatory agencies have required the suppression of dust and debris in one fashion or other, quite commonly by the introduction of moisture of some sort into the hole being drilled. When sufficient moisture is introduced into the quite finely particulated rock debris in a drill hole, the particulate matter tends to agglomerate on the walls of the hole being drilled behind the drill bit and this tends to make drill extraction from the drilled hole more difficult than in a dry hole. No amount of air pressure applied in the hole through the bit seems to remove all of this type of debris from the walls of the drilled hole and bit collaring on retraction is very substantially increased, oftentimes cutting the footage of hole that a driller can drill in a given period of time by fifty percent and raising equipment expenses because of lost bits and drill rod. The increase in collaring is apparently caused substantially by the agglomerated particulate matter adhering to hole walls wedging between those walls and the rearward facing surfaces of the bit as it is being extracted. The general shape and gauge clearance of a bit required for successful drilling operations apparently enhance the potentiality of collaring by reason of the wedging effect of the retracting bit.

Figure 5:
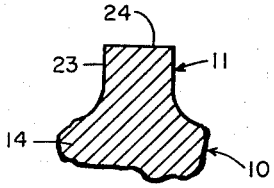
FIG. 5 is a somewhat enlarged, partial cross-sectional view through one of the helical ribs of the drill bit of FIG. 1, taken on the line 5—5 thereon in the direction indicated by the arrows.

My invention provides at least one helical rib 11 positioned on the outer surface of drill bit 10 rearwardly of the drilling portion and on the transition shoulder and shank portions. The rib shown in FIGS. 1 and 5 is of a substantially square cross-sectional shape having similar sides 23 and outer surface 24 though the shape of the rib does not appear to be particularly critical. The radial dimension of the rib (normally away from the bit axis) should be such as to position outer surface 24 substantially the same diameter as the external surface of drilling portion 12 defining the gauge angle. The rib is spirally oriented on the drill bit, as illustrated especially in FIG. 1, preferably with about a ninety degree advance throughout its length with the rearward or shank portion advanced from the forward or transition portion in the direction of normal drill rotation (the same direction as the threads of the drill stem). Commonly, as illustrated, modern day bits are designed to rotate in a counter-clockwise fashion as viewed from the rear and shown by arrows 26, but obviously my invention may be used upon bits rotating in either direction so long as the direction of advance of the ribs in a forward direction is opposite the direction of rotation of the bit so that material contacted by the ribs wll be moved toward the forwardmost portion of the ribs when the supporting bit be rotated.

One or more of such ribs may be used with the bit and the operation is the same whatever the number of ribs be. With the type of bit illustrated I prefer to use two ribs symmetrically arranged on the bit surface as illustrated. Preferably the forwardmost portion of the rib will terminate on the trailing edge or side of a larger flute as illustrated so that particulate matter moved forward by the rib will move into the flute to pass therethrough as the bit be extracted from a hole. The rib obviously is not particularly operative unless it move particulate matter to a flute passageway and therefore the number of ribs on a bit is generally practically limited to the number of flutes, though in actual practice I have found two ribs to be quite sufficient for most impact drills of normal configuration.

The material from which my rib is formed or its method of formation are not particularly critical to my invention though there is a substantial amount of wear on the rib and it should be formed of material at least as hard as that from which the body of the bit is formed. The rib may be formed by welding, separately formed and joined to the bit by welding, or formed as a part of the bit in its formation process such as by drop forging. However the rib be formed it must be remembered that commonly in the present day state of the art carbide inserts 16 are positionally maintained in a drill bit by means of silver soldering and that the bit itself is commonly tempered by some sort of heat treatment so the method of adding the rib must respect each of these other processes so as not to nullify them. The dimensioning of the rib, again, is not particularly critical so long as the radial dimensioning requirement be observed. I have found, however, that a rib of approximately square cross-section, that is, the width being limited by the radial dimension, is to be preferred.

In normal operation an impact drill bit of the nature illustrated in FIG. 1 will cyclically impact parallel to the bit axis upon material being drilled and at the same time will move rotationally, in the instance illustrated, in a counter-clockwise direction. A drill embodying my invention is used to drill a hole in the same fashion as a drill not embodying it and I find that my invention does not materially change the drilling effectiveness of the bit. My invention may lessen effectiveness very slightly but if at all by not more than approximately two percent in either expended labor or power. When a hole has been drilled and it is desired to extract the bit and drill stem, the drill rotation is continued in its normal drilling direction, that is counter-clockwise in the ordinary drill, and the drill stem is pulled rearwardly out of the hole by the drill. As this occurs particulate debris agglomerated on the sidewalls of the hole behind the drill bit is contacted by the ribs of my invention and moved by them in a forward direction to flutes 15*a* in drilling portion 12 of the drill bit from whence the particulate matter moves through the flutes and forwardly of the drill bit as that bit is moved rearwardly. Air pressure may or may not be applied during the extraction process depending upon the parameters of the particular situation. In a hole that is only partially blocked rearwardly of a drill bit pressurized or 'blow' air generally aids bit removal and aids in keeping the hole clean of debris rearwardly of the bit to aleviate potential collaring. In a hole that is completely collared, caved or otherwise plugged rearwardly of the bit with rock spalls, clay or the like no air generally can escape out of the hole and application of blow air in this instance may only make bit extraction more difficult. Apparently blow air in the latter case tends to prevent debris in the hole rearwardly of the bit from passing forwardly of the bit only to nullify the action of my ribs. The best removal procedure for any particular situation must largely be established by trial and experience.

From the foregoing description it is to be particularly noted that particulate matter will tend to be moved by my ribs forwardly past a drill bit being extracted from the hole and matter not being so moved will tend to be ground or otherwise forced from the walls defining the hole by the ribs. The material will be moved to flutes where it may readily pass forwardly of the drill bit rather than to the drilling surfaces that form the sidewalls of the hole where it would tend to wedge. With my invention then any particulate matter left in a drill hole tends to move forwardly of the bit being extracted rather than being forced from the hole by the bit.

It is further to be noted that the drill bit and drill stem may be continuously rotated in the normal drilling direction to maintain all threadedly engaged joints fully engaged. There is no tendency to disengage any of the compound parts of the bit or drill stem as might be done if the bit were not being so rotated or if it were subject to shock or impact during the removal.

It is further to be noted that although the foregoing description describes dry drilling with pressurized air, my bit may equally well be used in drilling with a fluid drilling media. It operates in substantially the same fashion with a fluid media as described for a gaseou media and tends to prevent collaring in substantially th same fashion.

The foregoing description of my invention is neces sarily of a detailed nature so that a specific embodimen of it might be set forth as required, but it is to be under stood that various modifications of detail, rearragemer and multiplication of parts might be resorted to withou departing from its spirit, essence or scope.

Having thusly described my invention, what I desir to protect by Letters Patent, and

What I claim is:

1. In an impact rock drill of the type having a large forward drilling portion communicating by a diametr cally smaller transition shoulder to a rearward shan portion diametrically smaller than the transition shou der, with plural peripherally spaced flutes define through the diametrically larger drilling portion an into the transition shoulder, the invention comprisin in combination:

at least one helical rib having a substantially squa cross-sectional shape positioned on the transitic shoulder and rearward shank portion and exten ing continously, from the juncture of drilling po tion and transition shoulder along the rearwa trailing edge defining a flute, spirally rearwardly an angle in the direction of the normal rotation the rock drill bit to tend to cause particulate mat rial contacted by the ribs to move forwardly the along and into the adjacent flute.

2. The invention of claim 1 wherein two similar ri extend from two opposed flutes of a bit.

3. An impact type rock drill bit having at least o helical rib on its surface to aid the extraction of the l from a drilled hole, comprising, in combination:

a drill bit having a diametrically larger drilling pc tion communicating by a sloping transition shoulder a diametrically smaller shank portion defining a di rod chamber with threaded means for releasably enga ing a drill rod, plural spaced flutes defined in axia parallel direction at least through the drilling portion allow passage of particulate matter past the drill ir drilled hole and means of introducing pressurized air the forward surfaces of the drill to aid the removal particulate matter therefrom; and at least one helical rib extending from the drilli portion, along the side defining a flute that is m distal from the direction of rotation of the bit, at angle toward the direction of rotation of the across the transition shoulder and shank member tend to move particulate material forwardly alc the rib and into the associated flute when the bit rotated, said rib extending radially outwardly from the drill bit a no further than the diametrically smallest par the drilling portion, being of substantially square cross-section throu out its length and having a lead of approximately ninety degrees c its length.

* * * * *